United States Patent [19]

Haskell

[11] 4,177,909

[45] Dec. 11, 1979

[54] CONVERTIBLE PURSE

[76] Inventor: Lois O. Haskell, 4550 Warwick Blvd., Kansas City, Mo. 64111

[21] Appl. No.: 842,574

[22] Filed: Oct. 17, 1977

[51] Int. Cl.[2] ..... A45F 3/04

[52] U.S. Cl. ..... 224/153; 224/46 R; 150/34; 150/52 R

[58] Field of Search ..... 224/46 R, 47, 8 R, 9, 224/5 R, 5 V, 31; 150/28 R, 30, 35, 34

[56] References Cited

U.S. PATENT DOCUMENTS

| | | | |
|---|---|---|---|
| 1,705,149 | 3/1929 | Brady | 150/34 X |
| 2,020,906 | 11/1935 | Rolfs | 150/34 |
| 2,105,319 | 1/1938 | Hedden et al. | 224/46 R |
| 2,157,280 | 5/1939 | Butman | 224/46 R X |
| 2,183,428 | 12/1939 | McNary | 150/34 |
| 2,612,199 | 9/1952 | Schocket | 150/34 |
| 2,764,201 | 9/1956 | Whippo | 150/34 |
| 3,346,155 | 10/1967 | Oechsle | 224/46 R X |
| 3,963,102 | 6/1976 | Carp | 150/28 R X |

FOREIGN PATENT DOCUMENTS

| | | | |
|---|---|---|---|
| 1010467 | 6/1952 | France | 224/8 R |
| 82752 | 11/1953 | Norway | 224/8 R |

*Primary Examiner*—Jerold M. Forsberg
*Attorney, Agent, or Firm*—Schmidt, Johnson, Hovey & Williams

[57] ABSTRACT

A convertible purse having three major components which may be separately and selectively utilized and independently or collectively carried by the user. The convertible purse may take the form of a large tote bag which may be carried by means of a shoulder strap or by means of crossed straps as a knapsack; a handbag which is carried within a major compartment of the purse and which may be separated therefrom to independently serve as a handbag, the handbag having means thereon for carrying cosmetic pouches and storing the same in the major compartment of the purse; and a clutch purse carryable by the handbag and also receivable within the major compartment of the purse. Each of the major components, the purse, the handbag and the clutch purse, is provided with pockets and compartments for individually and selectively receiving items to be carried therein whereby the overall convertible purse is capable of receiving and carrying a large number of items normally used in traveling or the like.

2 Claims, 13 Drawing Figures

CONVERTIBLE PURSE

It is the most important object of this invention to provide in a single unit, convertible purse, several separable components which, while they may all be initially carried within the convertible purse, may be individually utilized for separate functions and to receive differing items for carrying and use.

It is a further object of this invention to provide a convertible purse having carrying straps thereon whereby the purse may be carried in the nature of a tote bag; that is over one shoulder of the user thereof or, in the alternative, may be carried in the nature of a knapsack through utilization of a pair of crossed shoulder straps to position the convertible purse on the back of the user thereof.

It is yet a further object of this invention to provide a convertible purse having a body defined by a main panel and a front panel, the panels serving to define a plurality of pockets and compartments, there being presented a major compartment between said panels, which compartment is adapted to receive a handbag, the handbag in turn being capable of carrying a clutch purse attached thereto, and a plurality of cosmetic pouches, all of which may be inserted in the major compartment when carried by the handbag to the end that the entire convertible purse unit may include the multiple components desirable for a plurality of uses in traveling.

Other objects of this invention include the nature of fabrication of the convertible purse, the handbag, the clutch purse, and the cosmetic pouches; the manner in which the same may be integrated into a single, carryable convertible purse, the nature and location of various pockets and compartments, all to the end that there is presented a single unit capable of serving a multitude of purposes.

Figure 3:
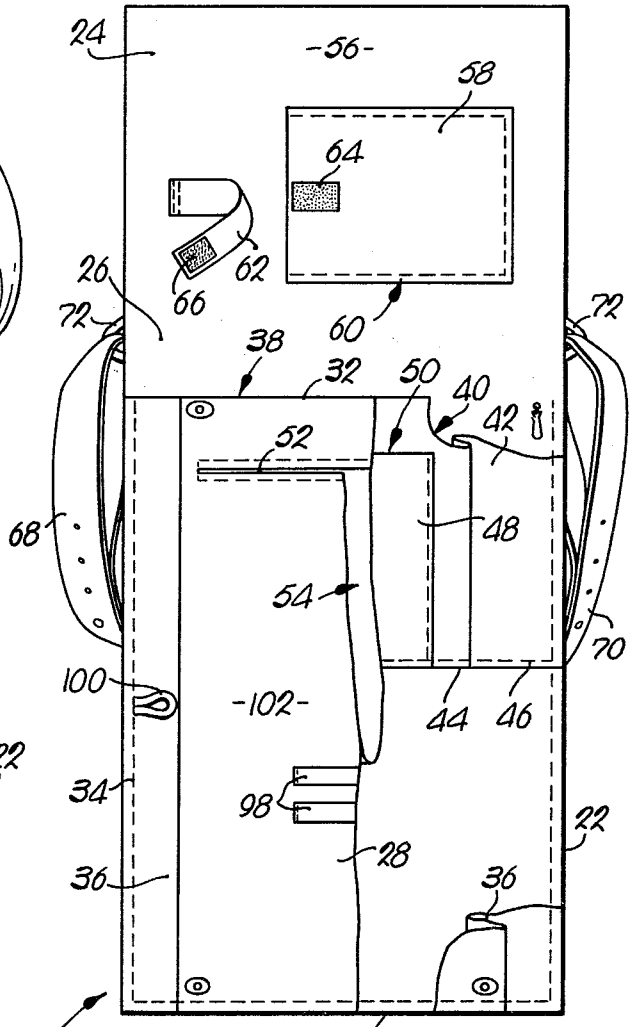
FIG. 3 is a front elevational view showing the convertible purse in an open condition, with portions broken away and shown fragmentarily to reveal details of construction.

The convertible purse 20 is basically comprised of a main panel 22 which consists of two sheets of flexible textile material having an inner facing therebetween to add rigidity thereto. Main panel 22 inculdes, at its normally uppermost end, a flap 24 which is swingable along a fold line 26 to a closed condition as shown for instance, in FIG. 1 of the drawings. The other face of the convertible purse 20 is generally defined by a sheet of textile material, preferably similar in nature to those constituting the main panel 22, said sheet being designated as 28, and overlying panel 22 from the normally lowermost end 30 thereof to a point adjacent fold line 26 whereby to present an upper edge 32. Sheet 28 is essentially identical in size and plan configuration to that portion of panel 22 below fold line 26. Sheet 28 is stitched to said main panel 22 as by lines of stitching 34. The sheet 28 is provided with gussets or expanding folds 36 along each longitudinally extending edge thereof whereby sheet 28 may cooperate with main panel 22 to define a major compartment 38. The major compartment 38 is coextensive in width and length with that portion of the main panel 22 normally disposed below the fold line 26 and is expandable outwardly through utilization of the expanding folds or gussets 36 to the extended position shown for instance in FIG. 5 of the drawings.

Carried between sheet 28 and proximal face of main panel 22 is a pocket 40 defined by a stretch of material 42 extending transversely between the longitudinal parallel side edges of the panel 22 and terminating at a point 44 where said stretch of material is secured by stitching 46 to said proximal face of the main panel 22. Thus, a short pocket 40 is presented within the confines of major compartment 38.

Further, and on the face of the stretch of material 42 next adjacent the sheet 28, there is shown a patch of material 48 to define yet another receiving pocket 50.

As an additional storage area, on the exterior of sheet 28, a slit 52 is provided which gives access to a lined slit pocket 54 which is intermediate the pieces of textile material which cooperatively define sheet 28.

The normally inner surface 56 of flap 24 is provided with an overlying piece of compatible material 58 to define a checkbook pocket 60 which may be closed through a locking strap 62, one end of the locking strap 62 being secured to inner surface 56 of flap 24, the other free end of locking strap 62 being engageable with fastening means 64 carried on the outer face of checkbook pocket 60 through compatible fastening means 66 carried on the free end of locking strap 62.

Figure 2:
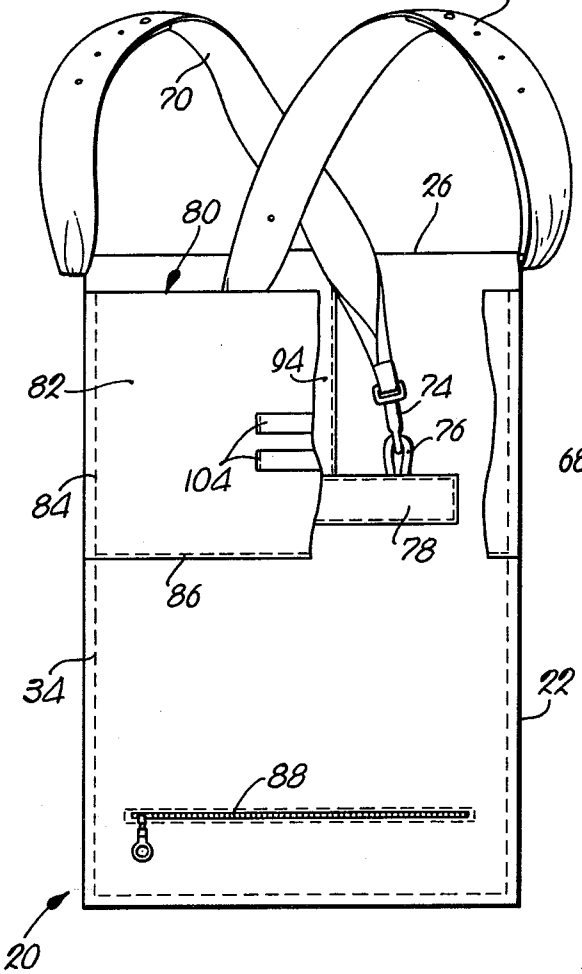
FIG. 2 is a rear elevational view of the convertible purse with portions broken away to show the manner of connection of the shoulder straps.
Figure 1:
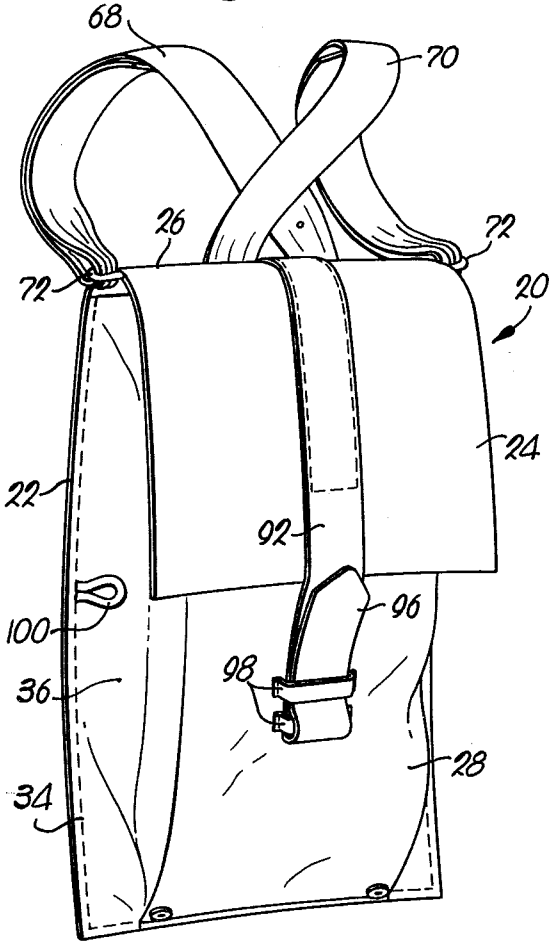
FIG. 1 is a front perspective view of the convertible purse showing the same with a pair of shoulder straps for carrying in knapsack fashion.

In order to permit carrying of purse 20 in the form of a knapsack, as illustrated for instance in FIGS. 1–3, there is provided a pair of carrying straps 68 and 70 which are suitably attached to the main panel 22 adjacent fold line 26 at the respective outer ends thereof, all as clearly illustrated. The attachment of straps 68 and 70 may be accomplished through utilization of suitable fastening means or by utilizing loops 72 as illustrated in FIG. 1. The other ends of carrying straps 68 and 70 are provided with hooks 74 which are engageable with eyes 76 carried by a reinforcing strip 78 secured to the rear face of main panel 22 as illustrated in FIG. 2. The reinforcing strip 78 and eyes 76 are disposed within the confines of a rear pocket 80 which is formed by an overlying flat member 82 secured to the rear face of main panel 22 as by stitching lines 84 and 86.

A lower rear portion of the rear face of main panel 22 has a zipper opening 88 formed therein to gain access to a storage area which is defined between the pieces of textile material serving to make up main panel 22.

It will be appreciated that when the purse 20 is to be carried on the back of the user thereof, the carrying straps 68 and 70 may be arranged as shown in FIGS. 1 and 2 to define crossed straps presenting openings for receiving the arms of the user and whereby to dispose the purse 20 on the back of the user in the form of a knapsack.

Figure 4:
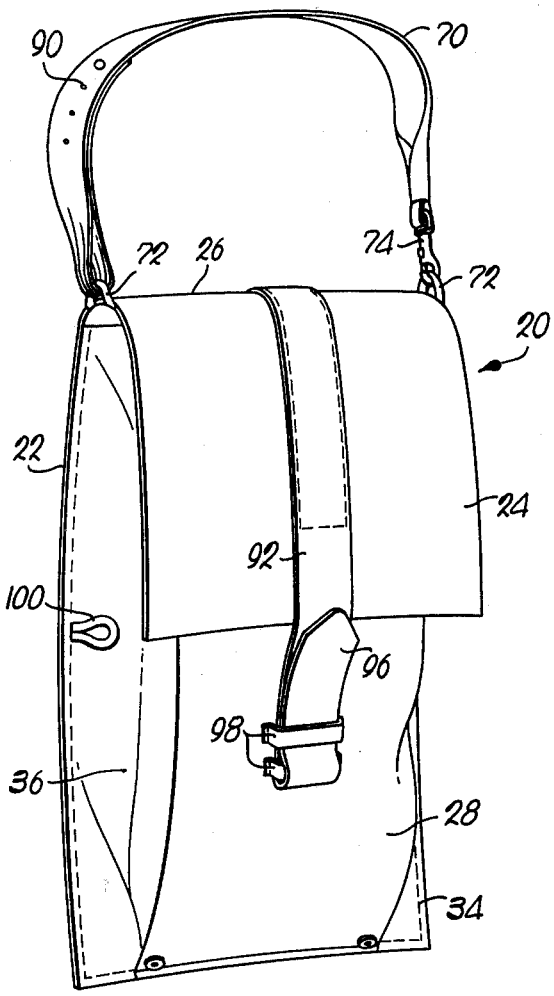
FIG. 4 is a front perspective view of the convertible purse showing the same with a single carrying handle for carrying in the nature of a tote bag.

On the other hand, when it is desired to carry the purse 20 in the form of a tote bag, that is on one shoulder of the user thereof, one of the straps such as 68 for instance, may be removed and placed in rear pocket 80 while the other strap, such as 70, may be arranged in the manner shown in FIG. 4 of the drawings, extending between the loop 72 on one side of the purse and the loop 72 on the opposite side thereof whereby to present a single carrying strap which may be placed over the shoulder of the user. It is contemplated that the single carrying strap such as 70, shown in FIG. 4, will be provided with apertures such as 90 therein and suitable locking means engageable with said apertures whereby the length of carrying strap 70 may be adjusted to accommodate the same comfortably to the user. When the purse 20 is carried as either a knapsack or a tote bag it is contemplated that the portion of main panel 22 below the fold line 26 will be in a fully extended position as shown in FIGS. 1–5, and that the flap 24 will be utilized to form a closure for the major compartment 38. To accomplish this, flap 24 has secured thereto a closure belt 92 which has one end secured to the rear of main panel 22 within the confines of rear pocket 80, as at 94, the closure belt 92 extending outwardly from said rear pocket 80 and being secured to the outer face of flap 24 along a major portion thereof, as shown in FIG. 4, whereby to leave a free end 96, which free end is engageable with a pair of locking loops 98 which are carried by the front of sheet 28.

Thus, the convertible purse 20 in the form shown in FIGS. 1–5 may receive items in the major compartment 38; in the short pocket 40; in the patch pocket 50; and in the checkbook pocket 60 and the entire contents thereof then securely closed by folding flap 24 along line 26 from the position shown in FIG. 3 of the drawings to the position shown in FIG. 4 of the drawings for safe carrying.

Figure 6:
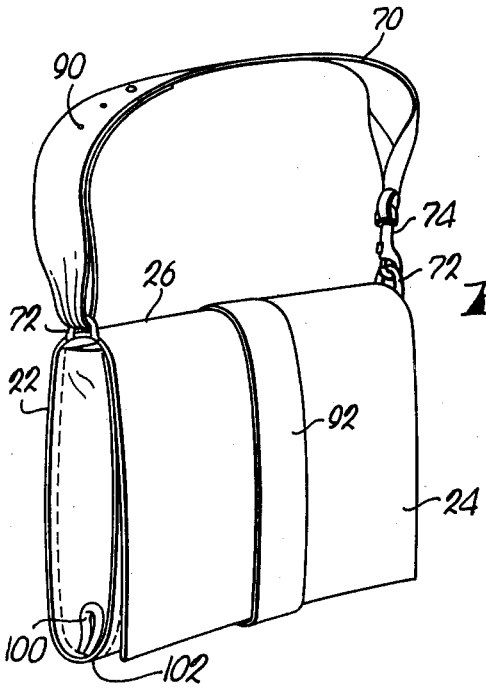
FIG. 6 is a perspective view showing the convertible purse folded into another configuration for carrying as a conventional purse.
Figure 7:
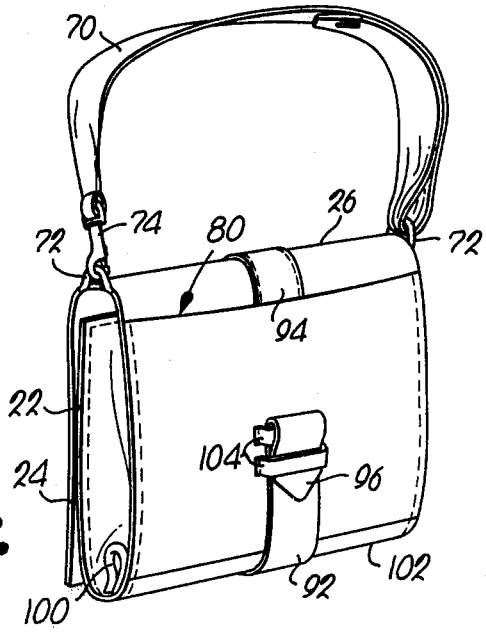
FIG. 7 is a perspective view showing the side of the purse opposite to that shown in FIG. 6.

The purse 20 is also provided with a pair of spaced-apart loops 100 in which the respective ends of a small umbrella may be inserted for carrying by the purse 20. When it is desired to utilize the convertible purse 20 in a smaller form such as shown for instance in FIGS. 6 and 7 of the drawings, and assuming that the contents of the respective compartments and pockets permit the same, there is provided a semirigid member (not shown) which extends transversely of the main panel 22 essentially between the spaced-apart loops 100 whereby to define a folding area 102 extending across main panel 22 between loops 100. By utilizing the folding area 102 the bottom portion of the purse, that is the area thereof normally below folding area 102, may be swung upwardly into overlying relationship with the normally uppermost area of the main panel 22; that is that area thereof normally lying above folding area 102, into the configuration shown in FIGS. 6 and 7 of the drawings. When this is done, there is presented a purse of essentially conventional but smaller overall size which may be carried preferably by a single carrying strap or handle 70 as shown in said Figures, the purse being closed as through utilization of belt 92 which, in the configuration shown in FIGS. 6 and 7, has its free end 96 received by locking loops 104 which are on the rear face of the main panel 22.

Figure 10:
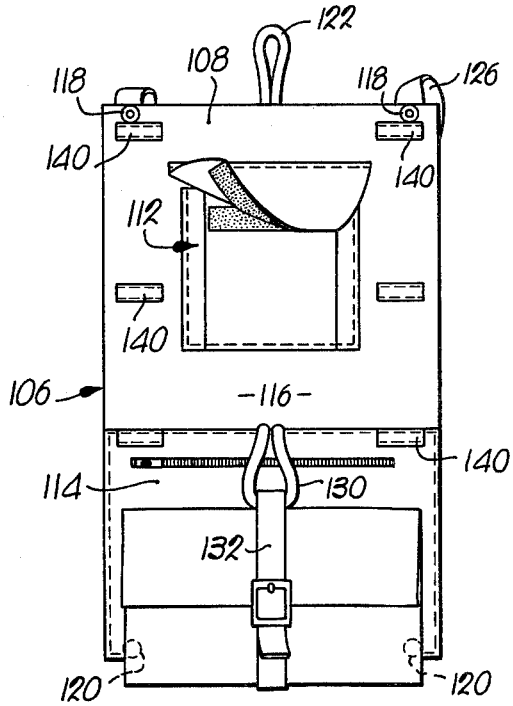
FIG. 10 is a front elevational view of the handbag in an open condition, carrying the clutch purse but with the cosmetic pouches removed.
Figure 9:
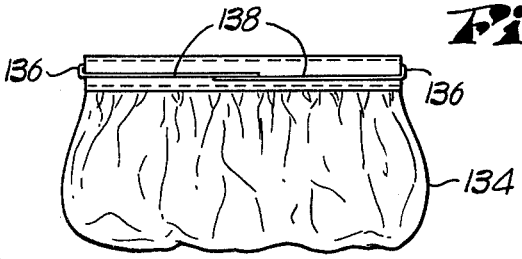
FIG. 9 is a rear elevational view of a single cosmetic bag.

If it is desired to expand the content carrying capacity of the convertible purse 20, there is provided a handbag 106, best shown in FIG. 10 of the drawings, the handbag being defined by a pair of opposed sheets of material with suitable inner facing therebetween whereby to present a front wall 108 and a rear wall 110. The plan configuration of handbag 106 in its open condition, as shown in FIG. 10, is of a size that said handbag, in said condition, is receivable within the major compartment 38 of purse 20 as will hereinafter be more fully detailed.

Figure 11:
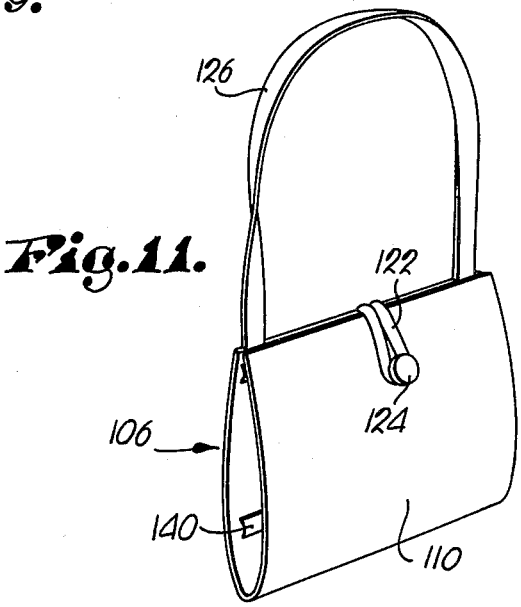
FIG. 11 is a front perspective view of the handbag in a closed condition.

Front wall 108 of handbag 106 is provided with an expansible pocket 112 on the normally uppermost portion thereof, and a zipper-closed article receiving area 114 on the normally lowermost face thereof, it being contemplated that handbag 106 will be foldable to a closed condition along a stretch 116 extending transversely thereof between pocket 112 and area 114. Wall 108 of handbag 106 is provided with suitable male fasteners 118 and female fasteners 120 at the upper corners and lower corners thereof respectively thereby; when the handbag is folded along stretch 116 it may be retained in its closed condition as shown in FIG. 11. When so closed, a loop 122 is engageable with a button 124 whereby to additionally retain the handbag in a closed condition, the bag being carriable by a handle 126.

In its open condition, the handbag 106 is utilized as a carrier for a clutch purse 128 by means of an eye 130 carried by wall 108 of bag 106 adjacent folding stretch 116, whereby a closure strap 132, secured to the clutch purse 128 may be engaged with the eye 130 to suspend the clutch purse from the handbag in the manner shown in FIG. 10.

Figure 8:
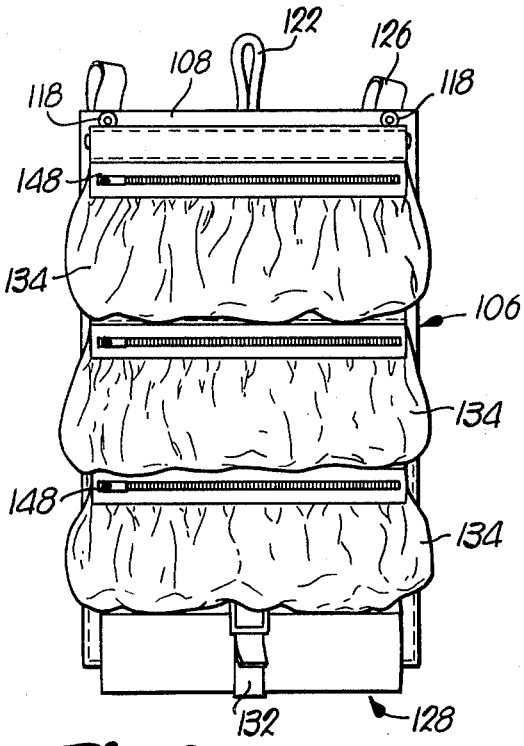
FIG. 8 is a front elevational view showing the handbag in an open condition and carrying three cosmetic pouches and the clutch purse.

Handbag 106, in its open condition, is also adapted to receive and carry one or more cosmetic pouches 134 as illustrated in FIG. 8 of the drawings. This is accomplished by providing the cosmetic pouches 134 with hooks 136 at each side thereof, which hooks have inwardly extending shank portions 138, which shank portions are receivable within corresponding slots 140 carried by the wall 108 of the handbag 106. It will be noted that there are three sets of said slots 140 on the wall 108 of handbag 106 whereby each pair of slots 140 may receive the corresponding shanks 138 carried by the cosmetic pouches 134 and thus suitably secure a plurality of said pouches 134 to the wall 108 of handbag 106.

Figure 12:
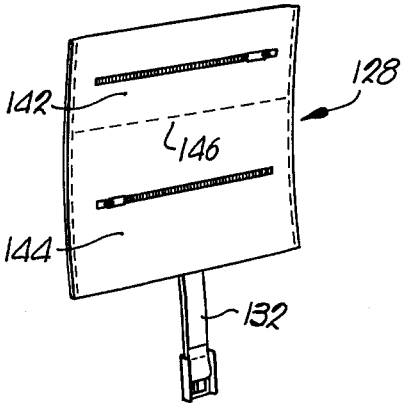
FIG. 12 is a perspective view of the clutch purse in an open condition.
Figure 13:
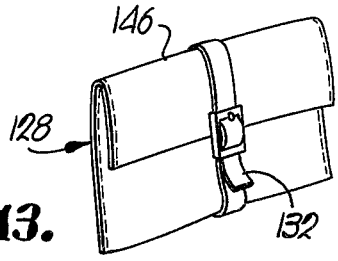
FIG. 13 is a perspective view of the clutch purse in a closed condition.

The clutch purse 128 is smaller than purse 20 or handbag 106 and may be provided with suitable zippered receiving areas such as 142 and 144 illustrated in FIG. 12, there being a line of fold 146 between said areas to permit folding of the clutch purse along said line 146 and into a closed condition as shown in FIG. 13, such condition being secured by utilization of closure strap 132.

The cosmetic bags 134 are of a flexible, preferably waterproof material and have zippered openings as at 148 along the normally uppermost edge thereof to permit access thereto. It will be appreciated that if it is desired to hang the handbag 106 in an open condition, such as shown in FIG. 8 for instance, and to gain access to the pouches 134, the loop 122 may be utilized to so position the handbag and to permit ready access to the pouches 134. The clutch purse 128 may of course, be removed for independent use.

Likewise, the pouches 134 may be removed from their position upon the wall 108 of handbag 106 and once the pouches 134 and clutch bag 128 have been so removed, the handbag may be utilized as such, by folding the same along stretch 116 to a closed condition, as shown in FIG. 11, and the same carried by means of the handle 126.

It is particularly important that the various components hereinabove described may be incorporated into a single cooperating convertible purse such as 20. In this regard, and in order to utilize to the maximum the various components, the pouches 134 would be attached to the wall 108 of handbag 106 by means of hooks 136 and particularly by engaging shank portions thereof within corresponding slots 140 to thereby position the pouches 134 on the front wall 108 of the open bandbag 106. The clutch purse would then be attached to handbag 106 by threading strap 132 through eye 130 whereby the clutch purse would be suspended from the front wall 108 of the handbag 106.

Figure 5:
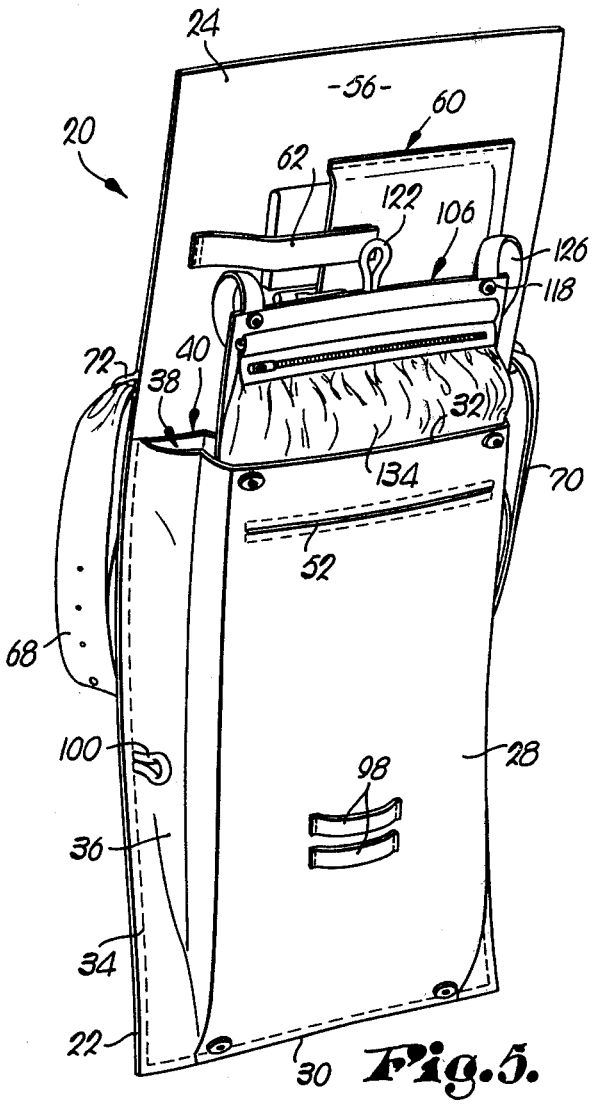
FIG. 5 is a front perspective view of the convertible purse showing the same in an open condition with the handbag and a cosmetic pouch carried thereby partially withdrawn from the major compartment.

Once this has been accomplished, and in order to permit the user to collectively carry all of the components, the handbag 106, in its open condition and carrying the pouches 134 and clutch purse 128, would be inserted within major compartment 38 of the purse 20 as shown, for instance, in FIG. 5 of the drawings, such insertion being permitted by virtue of the gussets 36.

Once the handbag and its associated components have been so positioned, the convertible purse 20 may either be carried in the form of a tote bag, as shown in FIG. 4, or the straps 68 and 70 may be arranged so that the convertible purse may be carried in the form of a knapsack as illustrated in FIG. 1 of the drawings. Normally, with the handbag 106 and its associated components within the major compartment 38, it would not be possible to fold the purse 20 along line 102 and thus the same would necessarily be carried in the manner shown in FIG. 1 or FIG. 4.

However, upon arriving at the destination, the traveler using the purse 20 could readily remove the handbag 106 from within major compartment 38 and hang the same in the manner shown in FIG. 8, through utilization of loop 122. The clutch purse 128 could then be removed for independent use.

The handbag 106 might continue to be used as a support for pouches 134 but, on the other hand, if the user desired to carry a bag of greater size than the clutch purse 128 but yet of smaller size than the purse 20, the pouches 134 would readily be removed; the handbag 106 folded along stretch 116 and the same independently packed and carried as a handbag through handle 126.

By the same token, and once the individual components have been separated as described above, the convertible purse 20 might continue to be utilized in the form of a tote bag or in the form of a knapsack. However, if a purse of a smaller size, but yet larger than handbag 106 or clutch purse 128 were desired, then purse 20 could be folded along folding area 102 whereby to bring the same into the configuration shown in FIG. 6 of the drawings, thus presenting a rather sizable purse having substantial capacity.

Thus there is presented in a single unit of cooperable components, a convertible purse which is capable of receiving a multitude of items of different sizes and configurations, but yet which is separable into its individual components whereby to present a main or convertible purse; a handbag; a clutch purse; and individual pouches. Such a convertible purse is obviously desirable, particularly for travelers inasmuch as the entire unit can be initially carried during traveling whereby to present its maximum capacity and utilization but, upon arrival at a destination, the individual components may be separated and independently utilized for carrying capacities of smaller volume and other desirable single uses.

Having thus described the invention, what is claimed as new and desired to be secured by Letters Patent of the United States is:

1. A convertible purse comprising:

a basic purse having at least one strap thereon and carryable in the form of a knapsack or a shoulder bag;

a main panel and a sheet of material secured thereto and cooperating therewith to define therebetween a major compartment presented by said basic purse, said main panel including a flap at its normally uppermost end, said main panel having a folding area extending transversely thereof, said basic purse being foldable along said area when the major compartment is empty, into overlapping relationship to present a hand carryable purse, there being a plurality of additional storage areas smaller than the major compartment formed in said basic purse, strap means on said flap fastenable to said sheet of material to close said major compartment when in the unfolded condition, and fastenable to the main panel to close said major compartment when in the folded condition;

a handbag adapted to be carried within said major compartment;

a clutch purse adapted to be carried by said handbag within said major compartment, said handbag and clutch purse being removable from said compartment and separable from one another for independent use;

at least one cosmetic pouch carried by said handbag and receivable within said major compartment together with the handbag;

said handbag having an open condition and a closed condition, the clutch purse and cosmetic pouch being carried by the handbag in its open condition, the handbag, clutch purse and cosmetic pouch being collectively receivable within said major compartment when the handbag is in its open condition, the handbag being independently usable as such when removed from the major compartment and placed in its closed condition; and means on the handbag for supporting the same in an open condition when removed from the major compartment whereby to carry said cosmetic pouch in a position of access.

2. A convertible purse as set forth in claim 1 said basic purse having means thereon for selectively receiving said straps whereby said basic purse may be carried by hand or on the back of the user thereof.

* * * * *